US006865849B1

(12) United States Patent
Mollinger et al.

(10) Patent No.: US 6,865,849 B1
(45) Date of Patent: Mar. 15, 2005

(54) TOP COURSE MOLDING

(75) Inventors: Paul J. Mollinger, Blacklick, OH (US); Paul R. Pelfrey, Wheelersburg, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 10/350,519

(22) Filed: Jan. 24, 2003

Related U.S. Application Data

(60) Provisional application No. 60/351,720, filed on Jan. 24, 2002.

(51) Int. Cl.[7] ..... E04B 7/00

(52) U.S. Cl. ..... 52/96; 52/716.2; 52/717.03

(58) Field of Search ..... 52/96, 58, 716.2, 52/717.03, 717.05, 716.1, 94

(56) References Cited

U.S. PATENT DOCUMENTS

| | | | | |
|---|---|---|---|---|
| 3,387,418 A | | 6/1968 | Tyrer | |
| 4,001,997 A | | 1/1977 | Saltzman | |
| 4,189,885 A | | 2/1980 | Fritz | |
| 4,319,439 A | | 3/1982 | Gussow | |
| 4,389,824 A | | 6/1983 | Anderson | |
| 4,608,800 A | | 9/1986 | Fredette | |
| 4,843,790 A | | 7/1989 | Taravella | |
| 4,920,709 A | | 5/1990 | Garries et al. | |
| 4,998,947 A | | 3/1991 | Dostall et al. | |
| D316,299 S | | 4/1991 | Hurlburt | |
| 5,022,204 A | | 6/1991 | Anderson | |
| 5,090,174 A | | 2/1992 | Fragale | |
| 5,103,612 A | | 4/1992 | Wright | |
| 5,230,377 A | * | 7/1993 | Berman | 160/327 |
| D342,579 S | | 12/1993 | Mason | |
| 5,282,344 A | | 2/1994 | Moore | |
| 5,392,574 A | | 2/1995 | Sayers | |
| D361,138 S | | 8/1995 | Moore et al. | |
| 5,461,839 A | | 10/1995 | Beck | |
| 5,533,308 A | | 7/1996 | Fullwood | |
| 5,560,170 A | | 10/1996 | Ganser et al. | |
| 5,581,970 A | | 12/1996 | O'Shea | |
| 5,586,415 A | | 12/1996 | Fisher et al. | |
| 5,660,010 A | | 8/1997 | Sayers | |
| 5,675,955 A | | 10/1997 | Champagne | |
| 5,678,367 A | | 10/1997 | Kline | |
| 5,694,728 A | | 12/1997 | Heath, Jr. et al. | |
| 5,720,114 A | | 2/1998 | Guerin | |
| 5,765,333 A | | 6/1998 | Cunningham | |
| 5,791,093 A | | 8/1998 | Diamond | |
| 5,829,206 A | | 11/1998 | Bachman | |
| 5,836,113 A | * | 11/1998 | Bachman | 52/94 |
| 6,035,587 A | * | 3/2000 | Dressler | 52/97 |
| 6,272,797 B1 | * | 8/2001 | Finger | 52/94 |
| D447,820 S | | 9/2001 | Grace | |
| D454,962 S | | 3/2002 | Grace | |
| 6,360,508 B1 | | 3/2002 | Pelfrey et al. | |
| 6,539,675 B1 | * | 4/2003 | Gile | 52/96 |

* cited by examiner

*Primary Examiner*—Naoko Slack
(74) *Attorney, Agent, or Firm*—Standley Law Group LLP

(57) ABSTRACT

A trim piece for use with siding. The trim piece includes a proximal end portion that is adapted to engage a support structure such as a clip. A cover piece extends from the proximal end portion. When used as top course molding, the cover piece may cover the nailing hem of an underlying piece of siding. A distal end portion of the cover piece may be comprised of a flexible plastic material in order to account for the slop of the siding.

17 Claims, 3 Drawing Sheets

TOP COURSE MOLDING

This application claims the benefit of U.S. Provisional Application No. 60/351,720, filed Jan. 24, 2002, the entirety of which is hereby incorporated by reference.

BACKGROUND AND SUMMARY OF THE INVENTION

The present invention relates generally to a siding trim piece. In particular, the trim piece of the present invention may be utilized to hide an edge of a piece of siding from view. In one embodiment, the trim piece may be situated at the top of a wall to cover the top edge of a piece of siding. In such embodiments, the trim piece may also be referred to as a top course molding. Accordingly, the trim piece of the present invention may be utilized to enhance the appearance of a siding installation.

DETAILED DESCRIPTION OF EXEMPLARY EMBODIMENT(S)

Figure 1:
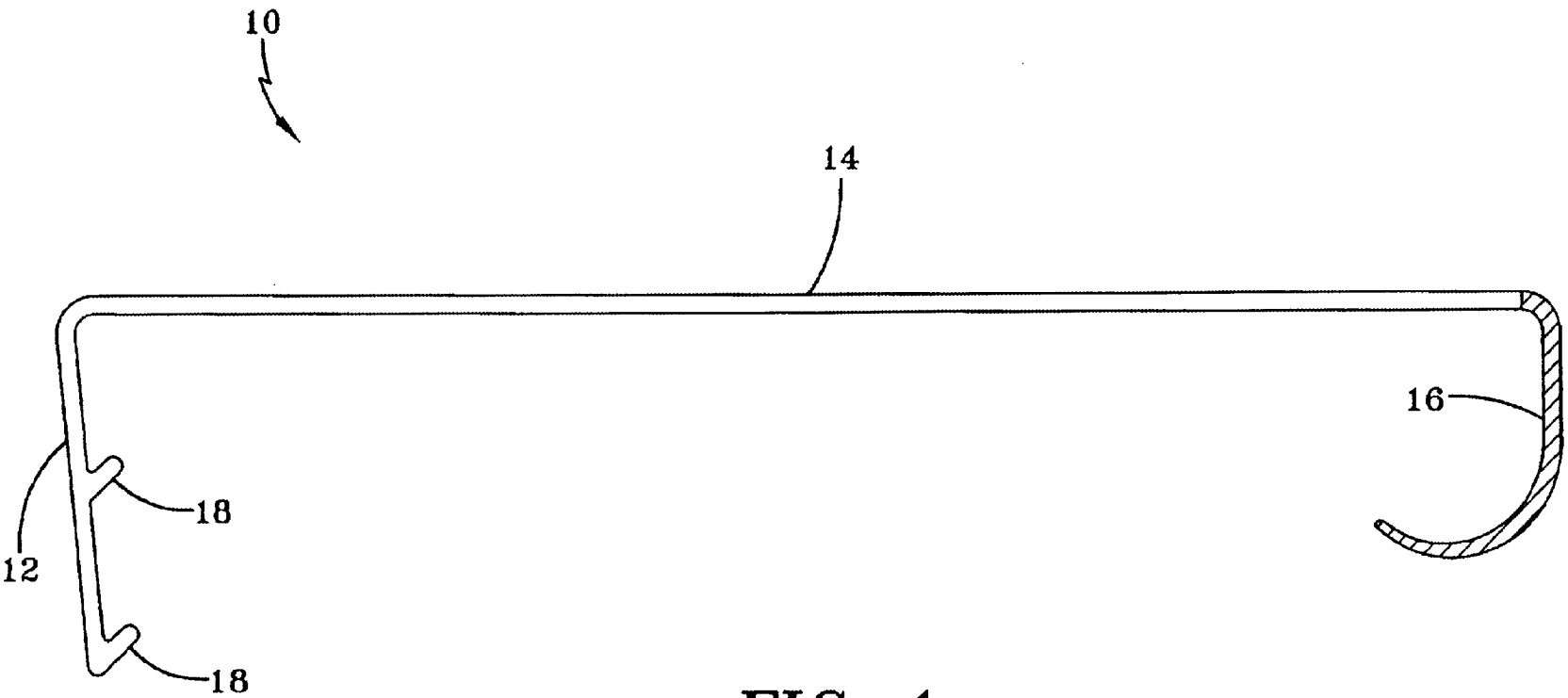
FIG. 1 is a side elevation view of one embodiment of a trim piece of the present invention. Cross-hatching is used to illustrate flexible plastic material.

The present invention is directed to a trim piece for use with siding and other similar or related structures or components. The trim piece may also be used to trim or frame structures or components that are not related to siding (e.g., other types of walls or wall components). FIG. 1 shows one embodiment of a trim piece 10 of the present invention. The trim piece 10 includes a proximal end portion 12 that is adapted to engage a desired structure, e.g., a wall, a post, a clamp, a clip, or any other similar, suitable, conventional, or desired structure. In this example, the proximal end portion 12 may include at least one rib or flange 18 to facilitate engagement with a desired structure. A cover piece 14 is connected to the proximal end portion 12. The cover piece 14 is adapted to hide, i.e., cover, items that are not desired to be seen. In this embodiment, the cover piece 14 is generally J-shaped, and it is connected to the proximal end portion 12 at about a 90 degree angle. However, it should be recognized that the cover piece 14 may have any other desired shape which enables it to cover the intended items. For example, the cover piece 14 may have a L-shape, a S-shape, or any other suitable or desired shape for covering the intended items. Likewise, the cover piece 14 may be connected to the proximal end portion 12 at any angle which enables it to cover the intended items. In this example, the distal end portion 16 of the cover piece 14 is also generally J-shaped. However, it should be recognized that the distal end portion 16 may have any other shape including, but not limited to, a L-shape, a S-shape, or any other suitable or desired shape to assist with covering the intended items.

Figure 3:
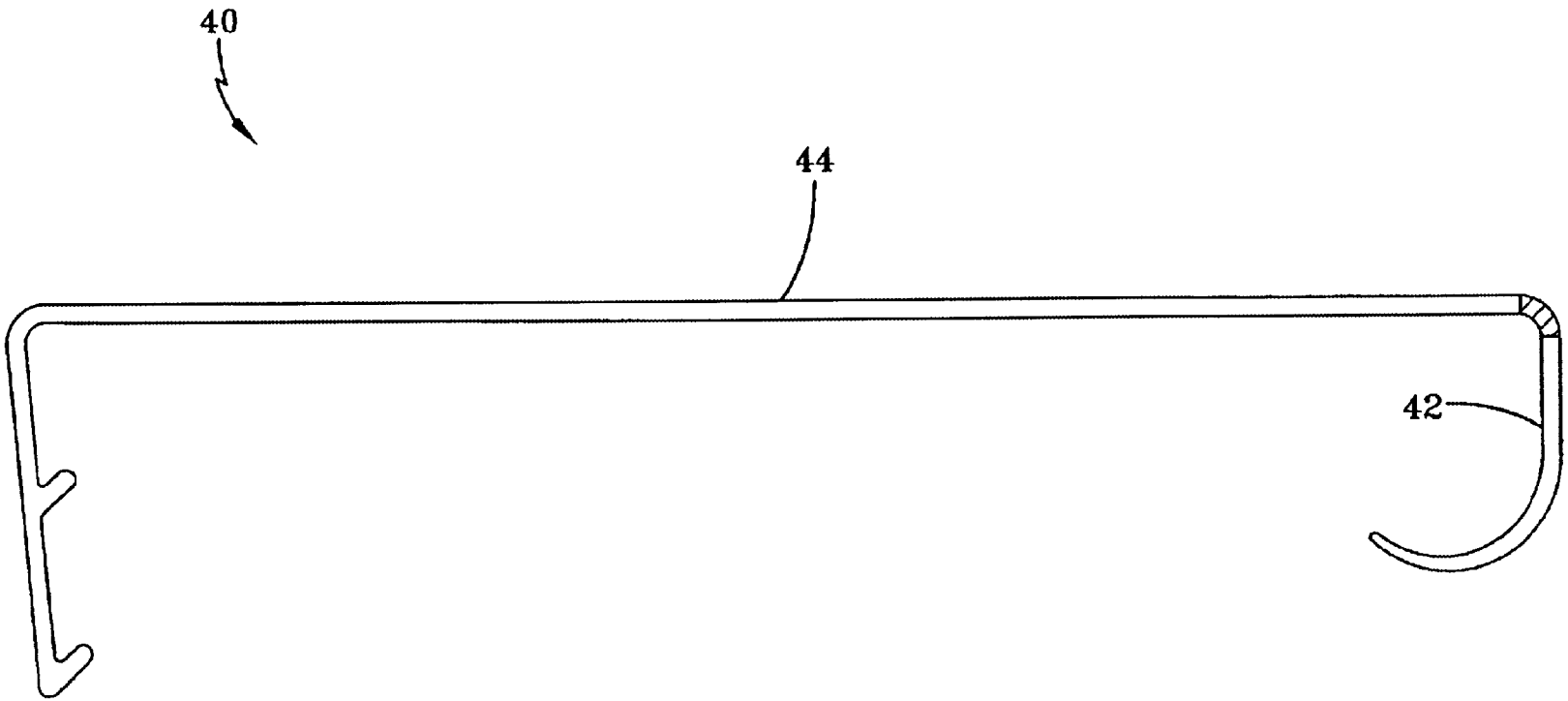
FIG. 3 is a side elevation view of one embodiment of a trim piece of the present invention. Gross-hatching is used to illustrate flexible plastic material.

The trim piece 10 may be manufactured by any suitable technique including, but not limited to, extrusion, compression molding, injection molding, and other similar or conventional manufacturing techniques. The proximal end portion 12 and the cover piece 14 may be comprised of any material(s) suitable or desired for the intended application of the trim piece 10. For example, the proximal end portion 12 and the cover piece 14 may be comprised of materials including, but not limited to, plastics, polymers, thermoplastics, inorganic-filled plastic composites, cellulosic-filled plastic composites, organic-filled plastic composites, foam composites, woods, metals, and other similar, suitable, or conventional manufacturing materials. Each of the portions of the trim piece 10 may be comprised of a flexible or rigid material. In one exemplary embodiment, the distal end portion 16 may be comprised of a flexible plastic material (such as indicated by cross-hatching), and the remaining portions of the trim piece 10 may be comprised of a rigid plastic material. For example, the distal end portion 16 may be comprised of a flexible vinyl or urethane compound (e.g., a flexible PVC compound) and the remainder of the trim piece 10 may be comprised of a rigid vinyl compound (e.g., a rigid PVC compound). In such an embodiment, the distal end portion 16 enables the cover piece 14 to adjust to the particular item that is to be covered. In another exemplary embodiment, such as shown by FIG. 3, the trim piece 40 may be comprised of a rigid plastic material (e.g., a rigid vinyl compound) except the general portion (such as indicated by cross-hatching) where the distal end portion 42 connects to the remainder of the cover piece 44, which may be comprised of a flexible plastic material (e.g., a flexible vinyl or urethane compound). Of course, it should be recognized that other flexible and rigid plastics may be used in the present invention in addition to vinyls and urethanes.

Figure 2:
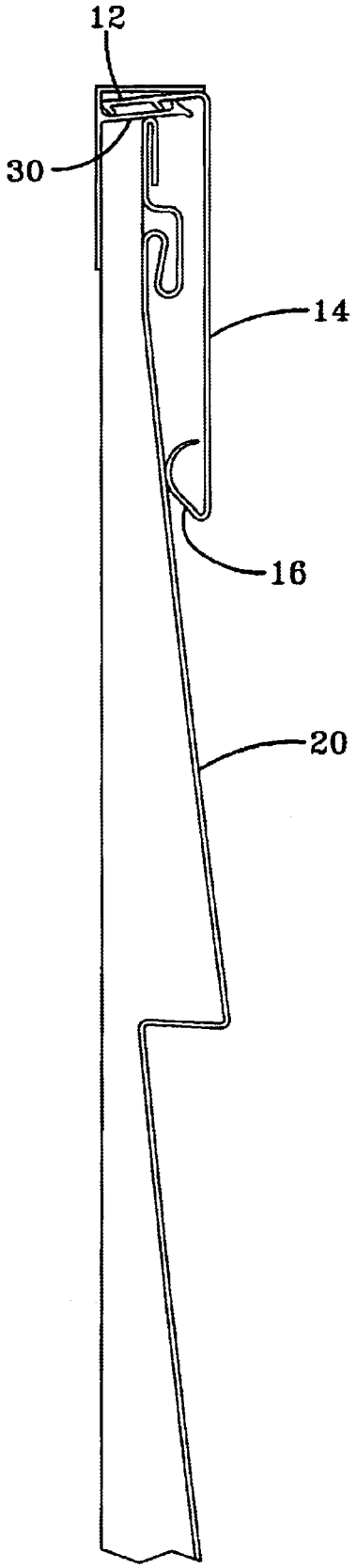
FIG. 2 is a side elevation view of an exemplary installation of the trim piece of FIG. 1.

FIG. 2 shows an exemplary use of the trim piece 10 as a top course molding. In this example, the cover piece 14 is covering the top edge of a piece of siding 20 which includes a nailing hem. The proximal end portion 12 of the trim piece 10 is engaged by a clip 30 to secure it in place. The distal end portion 16 abuts the piece of siding 20. In this example, the distal end portion 16 flexes in order to the account for the slope of the siding panel 20.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention.

What is claimed is:

1. A trim component comprising:

a generally J-shaped cover piece, said cover piece having a distal end portion that is also generally J-shaped;

wherein said distal end portion is at least partially comprised of a flexible plastic material and a remaining portion of said cover piece is comprised of a rigid plastic material.

2. The trim component of claim 1 wherein:

said flexible plastic material is a flexible vinyl compound; and said rigid plastic material is a rigid vinyl compound.

3. The trim component of claim 1 wherein:

a portion of said distal end portion that connects to said remaining portion of said cover piece is comprised of said flexible plastic material; and a remaining portion of said distal end portion is comprised of said rigid plastic material.

4. The trim component of claim 1 wherein said flexible plastic material is a flexible urethane compound.

5. A trim component comprising:

a proximal end portion adapted to engage a support structure; and a cover piece connected to said proximal end portion at about a 90 degree angle, said cover piece having a distal end portion that is generally J-shaped;

wherein said distal end portion is at least partially comprised of a flexible plastic material and a remaining portion of said cover piece is comprised of a rigid plastic material.

6. The trim component of claim 5 wherein said proximal end portion has at least one rib adapted to engage said support structure.

7. The trim component of claim 5 wherein said cover piece is generally J-shaped.

8. The trim component of claim 5 wherein:

said flexible plastic material is a flexible vinyl compound; and said rigid plastic material is a rigid vinyl compound.

9. The trim component of claim 5 wherein:

a portion of said distal end portion that connects to said remaining portion of said cover piece is comprised of said flexible plastic material; and a remaining portion of said distal end portion is comprised of said rigid plastic material.

10. The trim component of claim 5 wherein said flexible plastic material is a flexible urethane compound.

11. The trim component of claim 5 wherein said distal end portion is connected to said remaining portion of said cover piece at about a 90 degree angle.

12. A trim component comprising:

a proximal end portion having at least one rib adapted to engage a support structure; and a cover piece connected to said proximal end portion at about a 90 degree angle, said cover piece having a distal end portion that is generally J-shaped and at least partially comprised of a flexible plastic material;

wherein a remaining portion of said cover piece is comprised of a rigid plastic material.

13. The trim component of claim 12 wherein said cover piece is generally J-shaped.

14. The trim component of claim 12 wherein:

said flexible plastic material is a flexible vinyl compound; and said rigid plastic material is a rigid vinyl compound.

15. The trim component of claim 12 wherein:

a portion of said distal end portion that connects to said remaining portion of said cover piece is comprised of said flexible plastic material; and a remaining portion of said distal end portion is comprised of said rigid plastic material.

16. The trim component of claim 12 wherein said flexible plastic material is a flexible urethane compound.

17. The trim component of claim 12 wherein said distal end portion is connected to said remaining portion of said cover piece at about a 90 degree angle.

* * * * *

UNITED STATES PATENT AND TRADEMARK OFFICE

CERTIFICATE OF CORRECTION

PATENT NO. : 6,865,849 B1
DATED : March 15, 2005
INVENTOR(S) : Mollinger et al.

It is certified that error appears in the above-identified patent and that said Letters Patent is hereby corrected as shown below:

Column 1,
Line 27, please delete "Gross-hatching" and insert -- Cross-hatching --.

Signed and Sealed this

Seventeenth Day of May, 2005

JON W. DUDAS
*Director of the United States Patent and Trademark Office*